US009861238B2

(12) United States Patent
Phelps

(10) Patent No.: US 9,861,238 B2
(45) Date of Patent: Jan. 9, 2018

(54) SPINDLE ADAPTER FOR ROLL PAPER PRODUCT DISPENSERS

(75) Inventor: Stephen Lawrence Phelps, Lilburn, GA (US)

(73) Assignee: Solaris Paper, Inc., Alpharetta, GA (US)

( * ) Notice: Subject to any disclaimer, the term of this patent is extended or adjusted under 35 U.S.C. 154(b) by 472 days.

(21) Appl. No.: 13/288,868

(22) Filed: Nov. 3, 2011

(65) Prior Publication Data

US 2012/0104143 A1 May 3, 2012

Related U.S. Application Data

(60) Provisional application No. 61/409,668, filed on Nov. 3, 2010.

(51) Int. Cl.
*B65H 49/18* (2006.01)
*A47K 10/40* (2006.01)
*A47K 10/32* (2006.01)

(52) U.S. Cl.
CPC ..... *A47K 10/40* (2013.01); *A47K 2010/3253* (2013.01)

(58) Field of Classification Search
CPC ..... A47K 2010/324; A47K 10/40; A47K 2010/3253
USPC ... 242/596, 596.3, 596.4, 596.7, 596.8, 598, 242/598.3, 598.5, 598.6
See application file for complete search history.

(56) References Cited

U.S. PATENT DOCUMENTS 2,370,821 A * 3/1945 Stott ..... 242/422.4
2,459,252 A * 1/1949 Strahan ..... 242/560.3
2,561,584 A * 7/1951 McDonald ..... 242/598.3
2,606,724 A * 8/1952 Hertz ..... 242/598.1
3,291,354 A * 12/1966 Ziebarth ..... 225/79
3,850,379 A * 11/1974 Stern ..... 242/423.1
4,205,802 A * 6/1980 Economakis ..... 242/594.5
4,721,264 A * 1/1988 Muscarello ..... 242/598.6
4,913,364 A * 4/1990 Hu ..... 242/598.5
(Continued)

FOREIGN PATENT DOCUMENTS

EP 0452577 11/1991
JP 3154851 U9 11/2009
WO 2006/088397 8/2006

OTHER PUBLICATIONS

Patent Cooperation Treaty, "Notification of Transmittal of the International Search Report and the Written Opinion of the International Searching Authority, or the Declaration", PCT Application No. PCT/US12/63401, dated Mar. 19, 2013.

*Primary Examiner* — William A. Rivera
(74) *Attorney, Agent, or Firm* — Fish IP Law, LLC

(57) ABSTRACT

An adapter for a recessed dispenser is disclosed. The adapter includes a frame configured to fit into a cavity of the dispenser. The adapter also includes a fastener for securing the frame to the dispenser. The frame includes two arms extending away from the cavity. The two arms are configured to removeably couple with a reduced-core diameter spindle. The spindle can expand/contract and is configured for use with a reduced-core roll of paper product. The adapter described herein allows for rolled product to be dispensed from an existing recessed dispenser where the rolls being dispensed have a larger outer diameter and a smaller inner core diameter than allowed by the original design of the recessed dispenser.

17 Claims, 4 Drawing Sheets

(56) References Cited

U.S. PATENT DOCUMENTS

| | | | | |
|---|---|---|---|---|
| 5,464,170 | A * | 11/1995 | Mitchell et al. | 242/598 |
| 5,618,008 | A * | 4/1997 | Dearwester et al. | 242/594.5 |
| 5,718,404 | A * | 2/1998 | Greer | 248/309.2 |
| 5,845,870 | A * | 12/1998 | Angle | 242/598.5 |
| 6,138,939 | A * | 10/2000 | Phelps et al. | 242/596.7 |
| 7,316,369 | B2 * | 1/2008 | Phelps | 242/596.4 |
| 7,410,052 | B2 * | 8/2008 | Cook et al. | 206/233 |
| 7,568,652 | B2 * | 8/2009 | Cittadino et al. | 242/594.4 |
| 8,672,255 | B2 * | 3/2014 | Granger | 242/596.8 |
| 2003/0230666 | A1 * | 12/2003 | Chlipalski | 242/596.4 |
| 2004/0144883 | A1 | 7/2004 | Adler | |
| 2007/0267532 | A1 | 11/2007 | Phelps | |
| 2010/0078515 | A1 * | 4/2010 | Granger | 242/596.7 |
| 2012/0111989 | A1 * | 5/2012 | Dermo | 242/598 |

* cited by examiner

FIG. 7
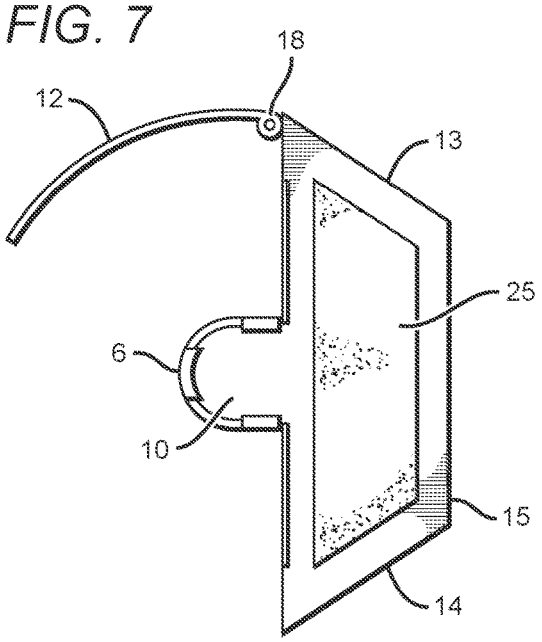
FIG. 8
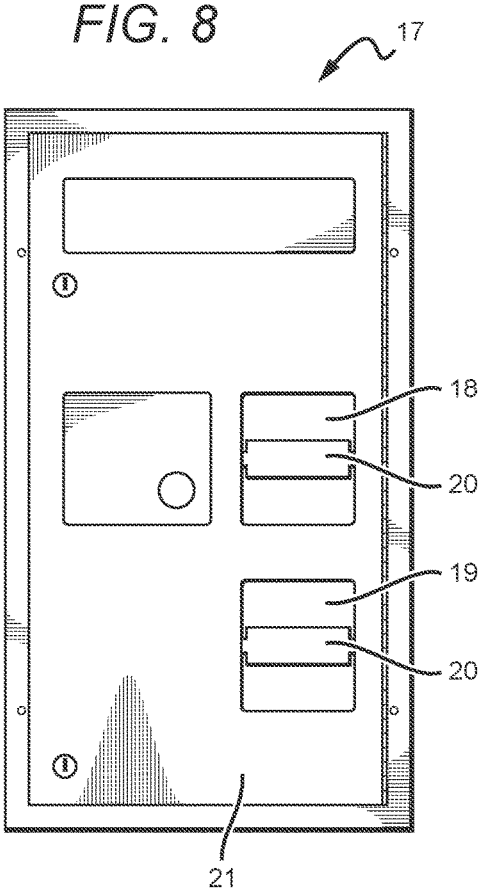
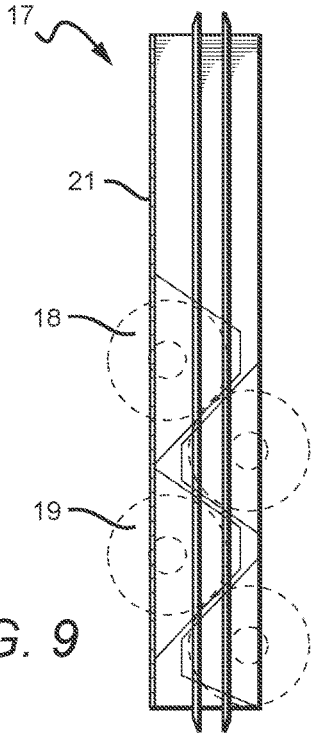
FIG. 9

SPINDLE ADAPTER FOR ROLL PAPER PRODUCT DISPENSERS

This application claims the benefit of priority to U.S. provisional patent application Ser. No. 61/409,668, filed on Nov. 3, 2010.

FIELD OF THE INVENTION

The field of the invention is roll paper product dispensers, more specifically, adapters for recessed paper product dispensers.

BACKGROUND

Recessed paper product dispensers are well known and generally comprise a cavity within a wall and two opposing recesses within the cavity walls for holding a spindle. A roll of paper product (e.g., toilet paper) is loaded into the cavity by placing the spindle through the center aperture of the roll and allowing the spindle ends to expand into the recesses in the cavity, thus holding the spindle in place for dispensing. Unfortunately, recessed dispensers can only be used with rolls that have an outer diameter that is smaller than the size of the cavity. This is very problematic for existing recessed dispensers since commercial manufactures of roll paper products have moved towards providing larger roll diameters and reduced-core center apertures. It would be advantageous to adapt existing recessed dispensers to allow larger diameter rolls having reduced cores to be loaded therein.

U.S. Pat. No. 7,316,369 to Phelps describes an adapter that allows recessed dispensers originally designed for cored rolls of paper product having a small outer diameter to be used with solid-core rolls having a much larger outer diameter. Due to the configuration of the adapter's spindle holders, the adapter is not compatible with cored rolls and reduced core rolls. As used herein, "solid-core" means a roll of product that has substantially no center aperture. As used herein, "cored" means a roll that has a center member around which the paper product has been wound (e.g., the cardboard cylindrical core in household toilet paper rolls) whereas "coreless" means a roll of product having no separate core member. "Coreless" also generally implies that the center aperture of the roll of product is less than that of a similar size roll having a core, although this may not always be the case. As used herein, "reduced-core" means a roll of product that has a core with a diameter that is substantially smaller than a standard or common core diameter (e.g., 1½ inches is currently the standard size diameter for cardboard cores in household toilet paper rolls).

This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Of particular interest in this application are adapters for recessed dispensers that allow use with reduced-core rolls of paper product. Reduced-core rolls reduce the amount of waste compared to larger cored rolls, while increasing the amount of usable paper product per roll. Reduced-core rolls also provide smoother winding than coreless rolls and solid-core rolls.

Phelps and all other known prior art fail to provide an adapter for recessed dispensers that allows the dispenser to be used with reduced-core rolls of paper product having a larger outer diameter than the dispenser's cavity. It has yet to be appreciated that an adapter for a recessed dispenser can allow the dispenser to be used with larger rolls that have reduced-cores.

Thus, there is still a need for improved adapters for recessed paper product dispensers.

SUMMARY OF THE INVENTION

The inventive subject matter provides apparatus, systems, and methods in which an adapter assembly for recessed dispensers includes a frame, a fastener, two arms extending from the frame, and a reduced-core spindle. The recessed dispenser has a cavity for accommodating a standard-sized spindle and a standard-size roll of paper product. The adapter's frame is configured to be at least partially disposed in the cavity. The fastener is for fastening the frame to a surface of the recessed dispenser, such as the cavity sidewalls or outer walls of the dispenser. The two arms are coupled to the frame and extend outward from the cavity. The arms are configured to securely retain a reduced-core spindle there between. For example, the arms could include two opposing recesses axially aligned and configured to receive the ends of the reduced-core spindles. In this manner, the adapter assembly disclosed herein allows dispensers originally designed for smaller rolls having standard-size cores to be used with larger rolls having reduced-core sizes.

In one aspect of some preferred embodiments, the adapter assembly includes at least one stop configured to contact the dispenser's outer surface. The stop provides a means for properly aligning and installing the adapter assembly in a cavity of a recessed dispenser.

In another aspect of some preferred embodiments, the recessed dispenser's cavity has two opposing sidewalls with opposing recesses in each wall. The wall recesses are configured to receive a standard-sized spindle. The adapter assembly's frame includes two opposing tabs configured to contact the cavity's two opposing sidewalls. The fastener could comprise a double-sided tape between the tabs and the sidewalls or screws and screw-holes.

In yet other aspects, the frame also includes a traverse cross-member extending from the first tab to the second tab. Preferably, the frame, arms, tabs, and traverse cross-member are integrally formed and comprise a single part.

In one aspect of some preferred embodiments, each of the two arms has a recess that is smaller than recesses in the cavity sidewalls. The two arms are configured to hold a reduced-size spindle whereas the cavity wall is configured to hold a standard-size spindle, which is generally larger than the reduced-size spindle. In addition, the two arms could be removeably coupled to the frame, thus allowing interchangeability of different size arms for different sizes of rolls and role cores.

In another aspect of some preferred embodiments, the adapter assembly includes a dust cover attached to the frame and extending outwardly from the cavity. The dust cover preferably attaches to the frame by a hinge. In addition, the dust cover preferably has a curved surface having a curvature concurrent with a roll of paper product, thus protecting the roll of paper product from dust and debris.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 7 is a side view of the adapter assembly of FIG. 1 without the roll of toilet paper.

FIG. 8 is a front view of one embodiment of a dual-roll recessed dispenser.

FIG. 9 is a side view of the dual-roll recessed dispenser of FIG. 8.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

For illustrative purposes, the present invention will be described and illustrated as it relates to rolls of toilet paper. However, this should not be interpreted as a limitation of the invention. Those of skill in the art will appreciate that the present inventive subject matter has uses in any application involving rolls of a wound product, regardless of whether the product is a paper absorbent. Examples of other materials may include, but are not limited to; non-woven fabrics, films, textiles, screens, meshes, and composite or laminates containing one or more of the above. Examples of products include rolls of stamps, rolls of plastic wrap, rolls of aluminum foil, and rolls of tickets. Products of particular interest to the present application include paper towels, wet wipes, dry wipes, sheets, coverings, and the like.

Figure 2:
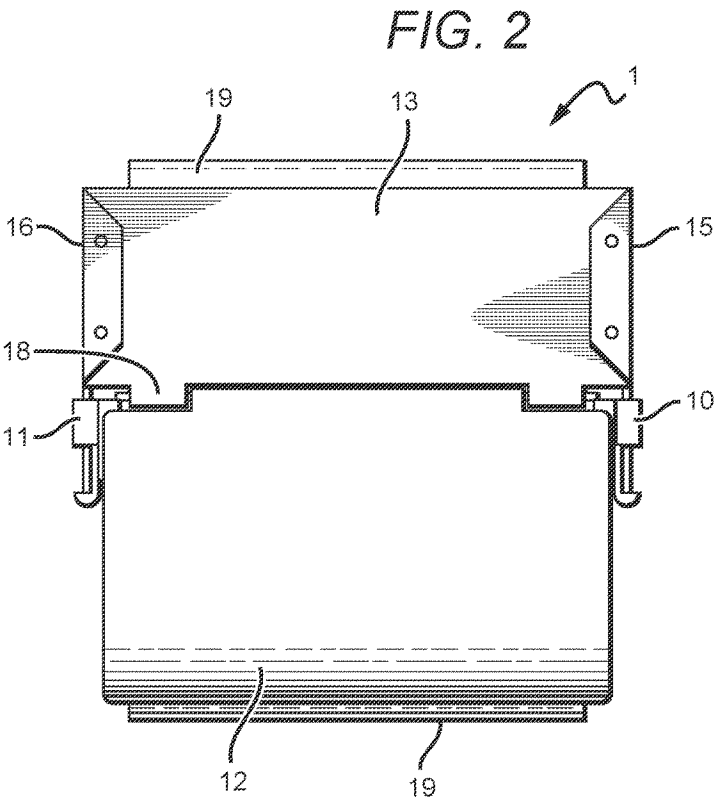
FIG. 2 is a top view of the adapter assembly of FIG. 1.
Figure 1:
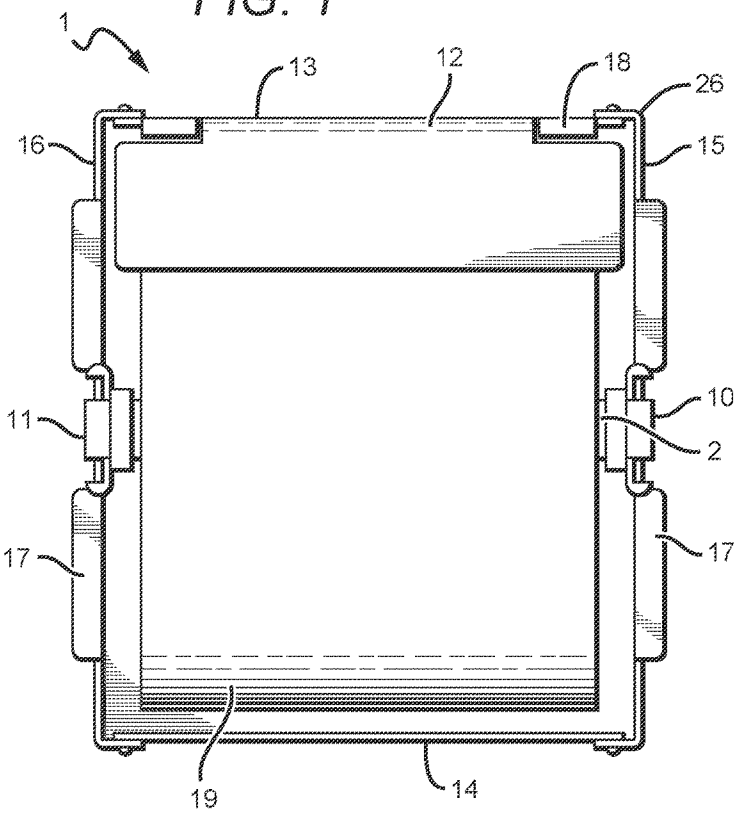
FIG. 1 is a front view of one embodiment of an adapter assembly for a recessed dispenser. The adapter assembly is holding a roll of toilet paper.
Figure 3:
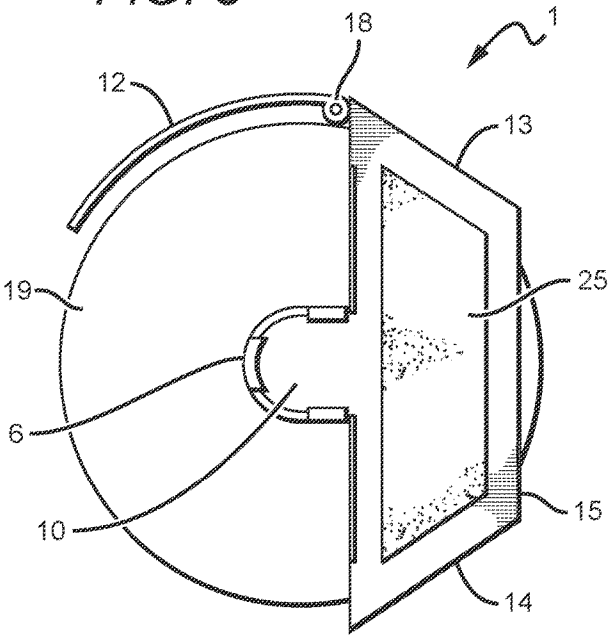
FIG. 3 is a side view of the adapter assembly of FIG. 1.

FIGS. 1-3 show front, top, and side views, respectively, of an adapter assembly 1 holding a roll of toilet paper 19. Adapter assembly 1 includes a frame 26 and a reduced-core spindle 2. Frame 26 is defined by: (i) right and left vertical walls 15 and 16 respectively (i.e., "tabs"); (ii) right and left side arms 10 and 11, respectively; and (iii) upper and lower cross members 13 and 14, respectively. Upper and lower cross members 13 and 14 are coupled with right and left vertical walls 15 and 16, creating a specific spaced-apart distance between right and left side arms 10 and 11. Right and left arms 10 and 11 have right and left spindle receivers 6 and 7 for holding spindle 2. Although FIGS. 1-3 show upper cross member 13, lower cross member 14, right side vertical wall 15 and left side vertical wall 16 as individual parts, one skilled in the art will appreciate that these members could also be fabricated as one integral part, or any combination of subparts.

FIGS. 1-3 also show a dust cover 12, which is attached to upper cross member 13 by hinges 18. Dust cover 12 protects and covers roll of toilet paper 19 from dust and debris. In FIG. 1, adapter position stops 17 are shown as protrusions extending from right and left vertical walls 15 and 16. Stops 17 provide a means for properly aligning and installing adapter assembly 1 in a cavity of a recessed dispenser.

Figure 4:
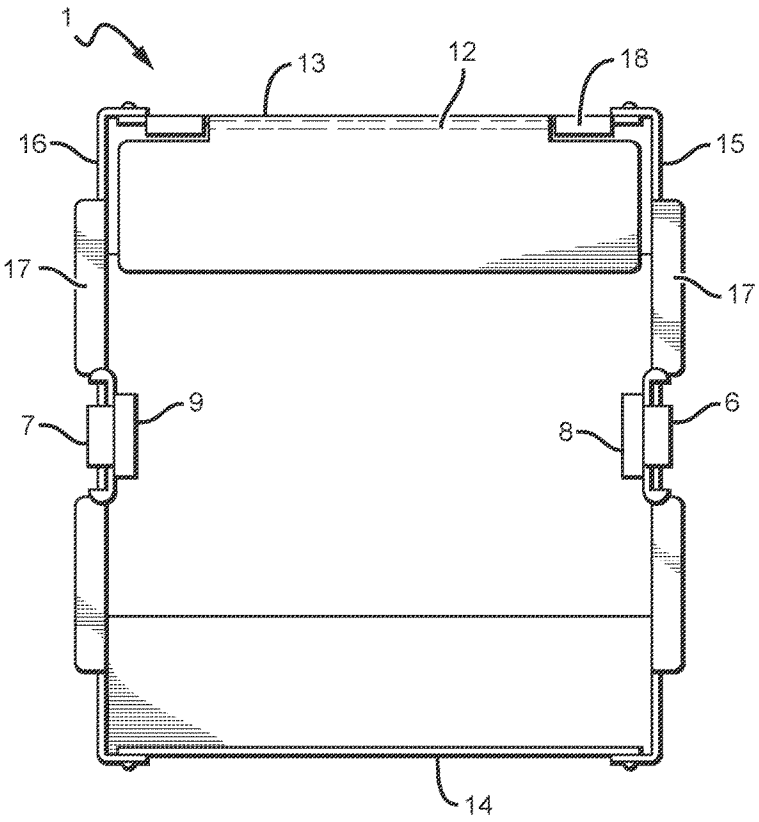
FIG. 4 is a front view of the adapter assembly of FIG. 1 without a roll of toilet paper and without a reduced-core spindle.

FIG. 4 shows a front view of adapter assembly 1 with roll of toilet paper 19 and spindle 2 removed. With spindle 2 removed, one can more clearly observe right and left spindle receivers 6 and 7, which are attached to the ends of right and left arms 10 and 11, respectively. Receivers 6 and 7 have receiver cups 8 and 9, respectively, for holding spindle 2.

Figure 5:
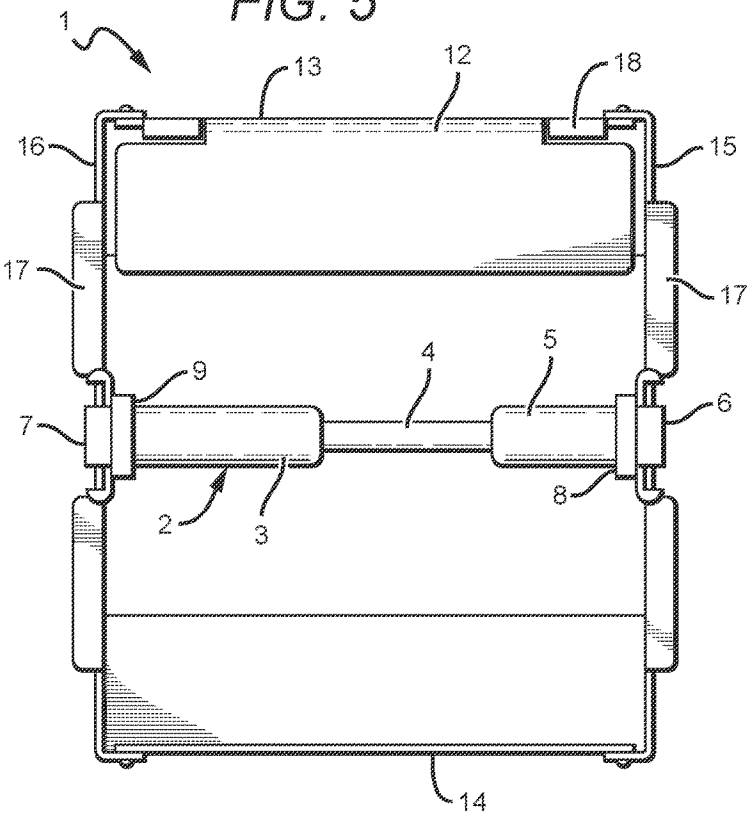
FIG. 5 is a front view of the adapter assembly of FIG. 1 without a roll of toilet paper and holding a reduced-core spindle.

FIG. 5 shows a front view of adapter assembly 1 with spindle 2 loaded between cups 8 and 9. Roll of toilet paper 19 has been removed. Spindle 2 comprises a housing 3 that slidably couples with a retractable arm 4 and arm end 5. Spindle 2 is similar to the spindle disclosed in co-pending U.S. patent application Ser. No. 13/288,257, filed on Nov. 3, 2011 to Phelps and titled "Spindle for Roll Paper Products," which is incorporated herein by reference. Spindle 2 can expand and contract, thus allowing the ends of spindle 2 to expand into cups 8 and 9. Those of skill in the art will appreciate that cups 8 and 9 could comprise any removable coupling suitable for holding spindle 2. For example, cups 8 and 9 could alternatively comprise two protrusions that fit into cups or recesses at the ends of spindle 2. Cups 8 and 9 could also comprise female connectors that releasably engage male connectors on the ends of spindle 2. The present inventive subject matter is not intended to be limited by the type of removable coupling used between spindle 2 and adapter assembly 1.

Spindle 2 is preferably a reduced-core spindle, meaning the maximum outer diameter of the spindle is smaller than the spindle originally intended for the recessed dispenser. In this manner, adapter assembly 1 and spindle 2 provide a means for retrofitting recessed dispensers to allow for use with larger rolls of toilet paper that have reduced cores.

Figure 6:
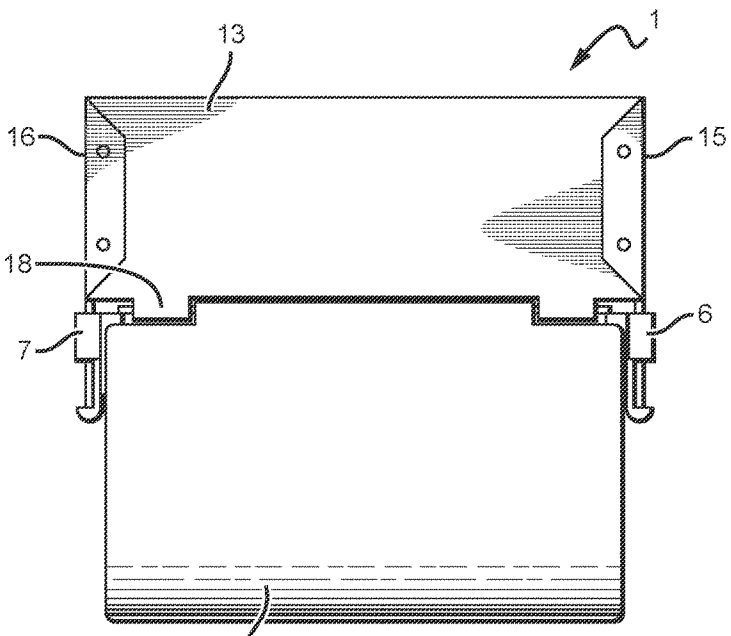
FIG. 6 is a top view of the adapter assembly of FIG. 1 without the roll of toilet paper.

FIG. 6 shows a top view of the recessed adapter assembly 1 shown with dust cover 12 attached to upper cross member 13 by hinges 18. In addition, FIG. 6 shows upper cross member 13 attached to right vertical wall 15 and left vertical wall 16.

FIG. 7 shows a side view of adapter assembly 1, showing a double sided tape fastener 25 attached to right vertical wall 15. Fastener 25 provides a means for attaching vertical wall 15 to a sidewall of a cavity of a recessed dispenser. Those of skill in the art will appreciate that numerous fastener types could be used consistently with the inventive subject matter disclosed herein. Any fastener suitable for supporting adapter assembly 1 to a cavity is contemplated. In alternative embodiments, the fastener could comprise screws and screw-holes. The fastener could also comprise expanding protrusions configured to engage recesses in the sidewalls of the cavity.

FIG. 8 shows a front view of the dual roll recessed dispenser 17, which is designed to mount to the partition separating two bathroom stalls. Each side of dual roll recessed dispenser 17 is usable by each stall user. Dispenser 17 includes a cavity 18 and a cavity 19 configured to accommodate a standard-sized roll of toilet paper having a standard-size core diameter. Both cavity 18 and 19 utilize a standard spindle 20. Spindle 20 is different from spindle 2 in that spindle 20 is configured to hold a standard-sized core diameter roll of toilet paper, not a reduced-core roll of toilet paper. As such, spindle 20 can utilize snap-fit connections, which are compatible with the larger dimensions of spindle 20. Adapter assembly 1 is configured to fit within cavities 18 and 19. With both standard spindles 20 removed, adapter assembly 1 can be inserted into cavities 18 and 19 until stops 17 contact front outer surface 21. Fasteners 25 can then be used to secure adapter assembly 1 to the sidewalls of cavities 18 and 19.

FIG. 9 shows a side view of the dual roll recessed dispenser 17 showing front surface 21, upper cavity 18, and lower cavity 19.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. An adapter assembly for recessed dispensers having a cavity comprising first and second opposing sidewalls that are sufficiently spaced apart to receive a spindle and a roll of paper product, the adapter assembly comprising:

a frame configured to be at least partially disposed in the cavity, the frame having:

right and left vertical walls spaced apart by a distance;

upper and lower cross members extending between the right and left vertical walls;

a first adhesive fastener coupled to at least one of the right and left vertical walls for fastening the frame to a surface of the recessed dispenser;

first and second parallel arms vertically and fixedly attached to the right and left vertical walls, respectively; and first and second receivers removably attached to the first and second arms, respectively, to allow for interchangeability for different sized rolls;

wherein the distance between the right and left vertical walls is such that, when the adapter assembly is installed in the cavity, the first adhesive fastener attaches to one of the first and second opposing sidewalls of the cavity;

wherein the first and second parallel arms extend outwardly from the right and left vertical walls to a first and second distance, respectively, and wherein the first and second receivers are disposed within the first and second distance, respectively;

wherein the first and second receivers have first and second cups, respectively, and wherein the first and second cups are disposed within the first and second distance, respectively, and are configured to receive first and second ends, respectively, of a reduced-core spindle to thereby hold the reduced-core spindle within the first and second distance.

2. The adapter assembly of claim 1, further comprising at least one stop configured to contact an outer surface of the recessed dispenser.

3. The adapter assembly of claim 1, wherein the frame comprises first and second opposing tabs extending from the right and left vertical walls, respectively.

4. The adapter assembly of claim 3, wherein the frame, first and second arms, first and second tabs, and upper and lower cross-members are integrally formed to comprise a single part.

5. The adapter assembly of claim 4, further comprising a second and third adhesive fastener disposed on the first and second opposing tabs, respectively.

6. The adapter assembly of claim 1, further comprising a first reduced-core spindle configured to expand into the first and second cups.

7. The adapter assembly of claim 1, wherein the first and second opposing sidewalls have first and second recesses, respectively, for receiving a standard-sized spindle.

8. The adapter assembly of claim 7, wherein the first and second cups have third and fourth recesses, wherein third and fourth recesses are smaller than first and second recesses.

9. The adapter assembly of claim 1, further comprising a dust cover attached to the frame and extending outwardly from the cavity.

10. The adapter assembly of claim 9, wherein the dust cover is attached to the frame with a hinge.

11. The adapter assembly of claim 9, wherein the dust cover comprises a curved surface having a curvature concurrent with a roll of paper product.

12. The adapter assembly of claim 1, wherein each of the first and second cups includes a recess configured to align with corresponding protrusions in the reduced-core spindle to securely retain the reduced-core spindle during dispensing of the roll of paper product.

13. The adapter assembly of claim 1, wherein the reduced-core spindle comprises first and second halves slideably coupled and axially aligned.

14. The adapter assembly of claim 13, further comprising a spring disposed between first and second spindle halves and configured to provide a compressible and expandable spindle.

15. The adapter assembly of claim 1, wherein the frame further comprises a first opening disposed on a back portion of the frame, and defined by (i) the right and left vertical walls, and (ii) the upper and lower cross members.

16. The adapter assembly of claim 15, wherein the frame further comprises a second opening disposed on a front portion of the frame, and defined by (i) the right and left vertical walls, and (ii) the upper and lower cross members.

17. The adapter assembly of claim 1, wherein the first and second cups face one another.

* * * * *